US006273754B1

(12) United States Patent
Bunch et al.

(10) Patent No.: US 6,273,754 B1
(45) Date of Patent: Aug. 14, 2001

(54) PROTECTIVE COVERING FOR THE TERMINAL ASSEMBLY OF A HERMETIC COMPRESSOR ASSEMBLY

(75) Inventors: Rick L. Bunch; Austin S. Miller, both of Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/548,401

(22) Filed: Apr. 13, 2000

(51) Int. Cl.[7] ..... H01R 13/40

(52) U.S. Cl. ..... 439/587; 439/935

(58) Field of Search ..... 439/587, 521, 439/693, 181, 150, 935, 932, 736, 174

(56) References Cited

U.S. PATENT DOCUMENTS

| | | | | |
|---|---|---|---|---|
| 3,009,986 | | 11/1961 | Stephens | 174/84 |
| 3,155,448 | | 11/1964 | Korsgren, Jr. | 339/201 |
| 3,316,343 | * | 4/1967 | Sherlock | 174/84 R |
| 3,388,368 | | 6/1968 | Sauber | 339/94 |
| 3,551,191 | | 12/1970 | Elbling et al. | 117/229 |
| 3,721,948 | | 3/1973 | Brandt et al. | 339/176 R |
| 3,988,053 | | 10/1976 | Dodenhoff | 339/278 C |
| 4,059,325 | | 11/1977 | Diminnie et al. | 339/94 A |
| 4,252,394 | | 2/1981 | Miller | 339/94 A |
| 4,296,275 | | 10/1981 | Bowsky | 174/152 GM |
| 4,461,925 | | 7/1984 | Bowsky et al. | 174/152 GM |
| 4,580,003 | | 4/1986 | Bowsky et al. | 174/152 GM |
| 4,584,433 | | 4/1986 | Bowsky et al. | 174/152 GM |
| 4,640,669 | | 2/1987 | Gannaway | 417/410 |
| 4,786,762 | | 11/1988 | Bowsky et al. | 174/152 GM |
| 4,824,378 | * | 4/1989 | Betz | 439/55 |
| 4,842,492 | | 6/1989 | Gannaway | 417/312 |
| 4,875,838 | * | 10/1989 | Richardson, Jr. | 418/55 |
| 4,964,788 | * | 10/1990 | Itameri-Kinter et al. | 417/422 |
| 4,984,973 | | 1/1991 | Itameri-Kinter et al. | 417/422 |
| 5,017,740 | | 5/1991 | Honkomp et al. | 174/152 GM |
| 5,391,061 | | 2/1995 | IIzuka et al. | 417/410.1 |
| 5,493,073 | | 2/1996 | Honkomp | 174/152 GM |
| 5,520,208 | * | 5/1996 | Schneider | 137/207 |
| 5,580,282 | | 12/1996 | Paterek | 439/685 |
| 5,637,007 | * | 6/1997 | Suzuki et al. | 439/276 |
| 6,011,093 | * | 1/2000 | Maly et al. | 524/62 |
| 6,107,566 | * | 8/2000 | Quadir et al. | 174/50.52 |

* cited by examiner

*Primary Examiner*—Tulsidas Patel
*Assistant Examiner*—Charles Peschel
(74) *Attorney, Agent, or Firm*—Baker & Daniels

(57) ABSTRACT

A hermetic compressor assembly including a housing; an electric motor disposed in the housing; a compression mechanism disposed in the housing and operatively coupled to the motor; a terminal assembly comprising a terminal body extending through and sealingly attached to the housing, at least one elongate conductor pin having interior and exterior ends, the interior pin end located inside the housing, the exterior pin end located outside the housing, and an insulator disposed between the pin and the terminal body, whereby the pin is electrically insulated from the terminal body by the insulator; a lead wire extending between the motor and the interior pin end, the lead wire having an electrical connection to the pin, the motor and the pin electrically connected by the lead wire, the lead wire having an insulative jacket; and an insulative covering which extends between the terminal body and the lead wire jacket, the insulative covering covering at least a portion of the terminal body, the insulator, the electrical connection between the lead wire and the pin, and at least a portion of the lead wire jacket.

47 Claims, 2 Drawing Sheets

PROTECTIVE COVERING FOR THE TERMINAL ASSEMBLY OF A HERMETIC COMPRESSOR ASSEMBLY

BACKGROUND OF THE INVENTION

The present invention relates to terminal assemblies for hermetic compressors, and means for preventing electrical arcing thereacross.

The terminal assembly of a hermetic compressor includes a plurality of conductor pins which extend through apertures located in a terminal body. The conductor pins are secured within these apertures by a glass insulator which electrically isolates the pins from the terminal body and the wall of the compressor housing through which the terminal body extends. The interior ends of the conductor pins are connected to lead wires running to the stator of the motor disposed within the compressor housing. The exterior ends of the conductor pins are selectively electrically connected, as through a switch device, to a source of electrical power.

During compressor operation, carbon or conductive deposits from the motor may collect on the interior surfaces of the housing and terminal assembly. These deposits may provide a conductive path between elements at differing electrical potentials, and a short circuit or arc may develop along that path. Such arcing results in resistive heating of the deposits along the conductive path, which heats the elements on which the deposits collect. Such heating is known to sometimes cause the fused glass insulators about the conductor pins to melt, thereby causing the compressor housing to leak pressurized gas at the terminal assembly.

Previous compressors including means for preventing the melting of the glass insulators have provided the insulators with an cover or coating which prevents the deposits from forming directly on the fused glass insulator. These means may include a plastic wafer or disk which is disposed over the interior of the terminal body to shield the fused glass insulator from the rest of the housing interior, the pins projecting through the wafer, their interior ends attached to the motor lead wires. Other means include coating the fused glass insulator with an epoxy, the coating extending from the conductor pins to the terminal body; the interior ends of the pins, however, remain uncoated to facilitate connection to the motor lead wires. Although these means may prevent carbon or conductive deposits from forming directly on the fused glass insulator, they do not prevent arcing between the interior ends of the conductor pins and the interior of the compressor housing. Further, resistive heating may melt the wafer or coating, the fused glass insulator melted by arcing across deposits later deposited directly on the formerly covered insulator.

It is desired to provide a means for preventing arcing across the interior of the terminal body altogether, thereby assuring the fused glass insulator will remain intact and a leak through the terminal body will not develop.

SUMMARY OF THE INVENTION

In accordance with the present invention, an insulative, protective covering is provided which extends between the terminal body and the jackets of the lead wires. The exposed conducting material of the lead wire, the lead wire/conductor pin connection, the fused glass insulator and at least a portion of the terminal body, are completely covered by the covering, which also extends over at least a portion of the lead wire jacket. Thus, there is no opportunity for carbon or conductive deposits to form a conductive path between metal components having different electrical potentials, and arcing is altogether prevented.

The present invention provides a hermetic compressor assembly including a housing, an electric motor and a compression mechanism, the motor and compression mechanism disposed in the housing and operatively coupled together. The compressor assembly also includes a terminal assembly having a terminal body which extends through and is sealingly attached to the housing, at least one elongate conductor pin having interior and exterior ends, the interior pin end located inside the housing, the exterior pin end located outside the housing, and an insulator disposed between the pin and the terminal body, whereby the pin is electrically insulated from the terminal body by the insulator. A lead wire having an insulative jacket extends between the motor and the interior pin end, and has an electrical connection to the pin, the motor and the pin electrically connected by the lead wire. An insulative covering extends between the terminal body and the lead wire jacket, and covers at least a portion of the terminal body, the insulator, the electrical connection between the lead wire and the pin, and at least a portion of the lead wire jacket.

The present invention further provides a hermetic compressor assembly including a housing, an electric motor and a compression mechanism, the motor and compression mechanism disposed in the housing and operatively coupled together. The compressor assembly also includes a terminal assembly having a terminal body which extends through and is sealingly attached to the housing, at least one elongate conductor pin having interior and exterior ends, the interior pin end located inside the housing, the exterior pin end located outside the housing, and an insulator disposed between the pin and the terminal body, whereby the pin is electrically insulated from the terminal body by the insulator. A jacketed lead wire extends between the motor and the interior pin end, and has an electrical connection to the pin, the motor and the pin electrically connected by the lead wire. The compressor assembly also includes means for continuously covering at least a portion of the lead wire jacket, the electrical connection between the lead wire and the pin, the insulator and at least a portion of the terminal body.

The present invention also provides a hermetic compressor assembly including a housing, a motor including a rotor and a stator disposed in the housing, at least one jacketed lead wire electrically connected to the stator, and a compression mechanism disposed in the housing and operatively coupled to the rotor. The compressor assembly also includes a terminal assembly having a terminal body which extends through and is sealingly attached to the housing, at least one elongate conductor pin extending through the terminal body, and an insulator disposed between the pin and the terminal body, there being an electrical connection between the lead wire and the conductor pin. The compressor assembly also includes means for insulatively covering the electrical connection, the conductor pin and the insulator.

The present invention also provides a method of applying an insulative covering over the electrical connection between the terminal assembly and the motor of a hermetic compressor, comprising the steps of: providing a terminal assembly comprising a body, at least one conductor pin extending through the body, and an insulator disposed between the body and the pin, at least one jacketed lead wire, and an insulative covering material; establishing an electrical connection between the lead wire and the conductor pin; and applying the insulative covering material over at least a portion of the terminal body, the insulator, a portion of the conductor pin, the electrical connection between the lead wire and the pin, and at least a portion of the lead wire jacket.

In accordance with the present invention, in certain embodiments thereof the insulative covering may be in the form of a sleeve made of insulative material, and which may be a molded boot. Alternatively, the insulative covering may be molded-in-place of insulative material.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
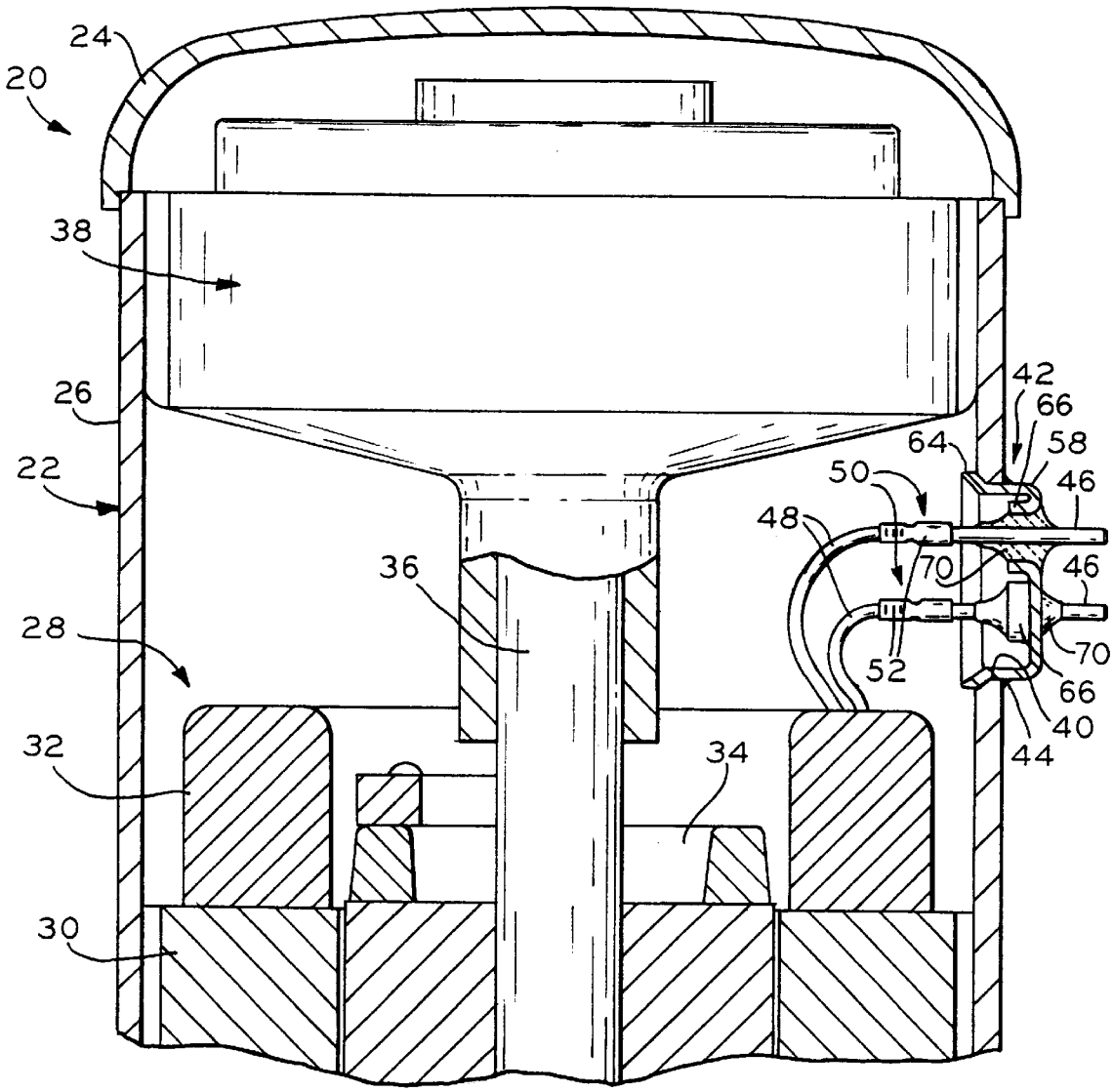
FIG 1 PRIOR ART
FIG. 1 is a fragmentary, partial sectional view of one embodiment of a previous hermetic compressor assembly into which the present invention may be incorporated.

Corresponding reference characters indicate corresponding parts throughout the several views. Although the drawings represent embodiments of the present invention, the drawings are not necessarily to scale and certain features may be exaggerated in order to better illustrate and explain the present invention.

DESCRIPTION OF THE PRESENT INVENTION

Referring to FIG. 1, hermetic compressor 20 comprises housing 22 which includes upper housing portion 24 sealingly disposed atop main housing portion 26; a lower housing portion (not shown) may also be included in housing 22. The housing portions are hermetically sealed by a method such as welding or the like. Hermetic compressor 20 further includes electric motor 28 disposed within housing 22. Motor 28 is secured within housing 22 in any conventionally known manner and includes stator 30 having windings 32. Motor 28 further includes rotor 34 which is surrounded by stator 30 and fixed to drive shaft 36.

As shown, the upper end of drive shaft 36 is operatively connected to compression mechanism 38, which may be in the form of a reciprocating compressor, a scroll compressor, or a rotary vane compressor, all of which are well-known in the art. A prior reciprocating compressor is disclosed in U.S. Pat. No. 4,842,492 (Gannaway), the disclosure of which is expressly incorporated herein by reference. A prior scroll compressor is disclosed in U.S. Pat. No. 4,875,838 (Richardson, Jr.), the disclosure of which is expressly incorporated herein by reference. A prior rotary vane compressor is disclosed in U.S. Pat. No. 4,640,669 (Gannaway), the disclosure of which is expressly incorporated herein by reference. Each of these three patents is assigned to the assignee of the present invention.

Compressor assembly 20, which may be part of a refrigeration system (not shown) also comprising heat exchangers, an expansion device and refrigerant conveying lines, receives refrigerant substantially at suction pressure and discharges it substantially at discharge pressure. In operation, suction pressure refrigerant gas may be drawn from outside housing 22 into compression mechanism 38 via a suction tube (not shown). Within compression mechanism 38, the suction pressure gas is compressed to a higher, discharge pressure, and then discharged from the compression mechanism into housing 22 substantially at discharge pressure. Thereafter, the compressed gas is returned to the refrigerant system via a discharge tube (not shown). Such a compressor may be of the type referred to as a "high side" compressor, the portion of the housing containing the motor being substantially at discharge pressure. Alternatively, suction pressure refrigerant gas may be drawn first into housing 22, and then into compression mechanism 38, compressed gas then discharged directly from the compression mechanism and the housing via the discharge tube. Such a compressor is referred to as a "low side" compressor, for the portion of the housing containing the motor is in a substantially suction pressure gas environment. Although the present invention is shown as being adapted to a high side compressor herein, it is to be understood that it may be adapted to either type of compressor.

Figure 4:
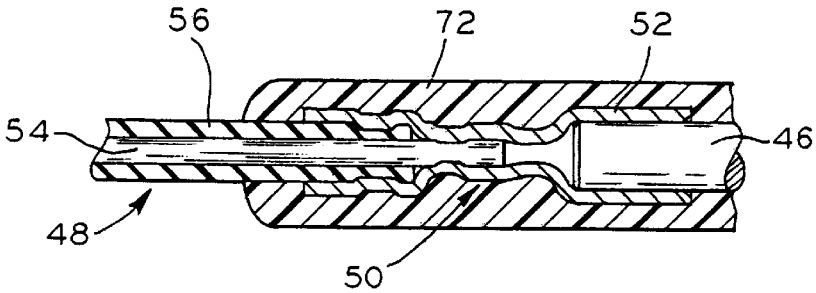
FIG. 4 is an enlarged longitudinal sectional view of the electrical connection between the interior end of a terminal assembly conductor pin and a jacketed lead wire, the electrical connection covered by an insulative covering in accordance with the present invention.

The wall of main housing portion 26 is provided with aperture 40 into which terminal assembly 42 is fitted and sealably secured at 44 by welding, brazing or the like. Terminal assembly 42 is provided to conduct electrical power from the outside of housing 22 to motor 28 while maintaining a hermetic seal, and is of a type well known in the art. As described above, an external power source (not shown) is selectively connected, as through a switch (not shown) to a plurality of metal conductor pins 46, which may be of any suitable material (e.g., steel) and construction. In the usual manner, a plurality of jacketed lead wires 48 extend from stator windings 32, each lead wire 48 having an electrical connection 50 with the interior end of a conductor pin 46 through a connector clip 52. Each connector clip 52 is crimped to conductive center wire portion 54 (FIG. 4) of lead wire 48, and may also be crimped over a portion of insulative jacket 56 (FIG. 4) which extends substantially the entire length of the wire. Clips 52 are fitted or crimped onto the interior ends of conductor pins 46. Thus, electrical power is transferred from the external power source (not shown) to stator windings 32 via pins 46 of terminal assembly 42 and lead wires 48. Energized, the stator electromagnetically induces rotation of rotor 34 to drive compression mechanism 38 through drive shaft 36.

Figure 2A:
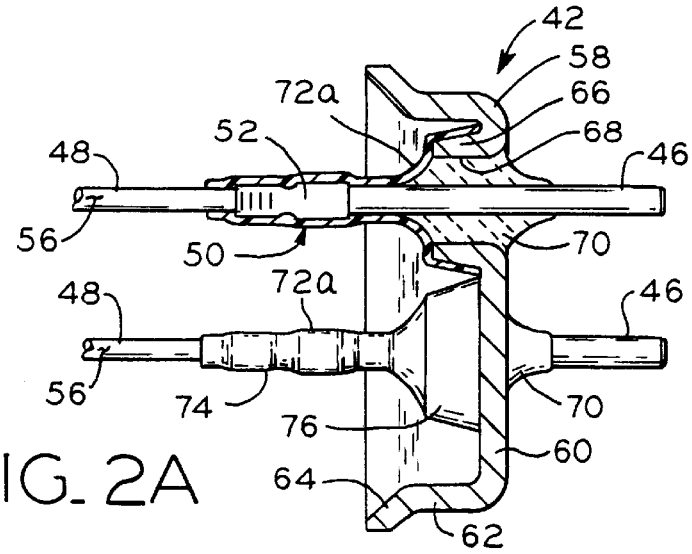
FIG. 2A is an enlarged longitudinal sectional view of the terminal assembly of the compressor of FIG. 1, the present invention having been incorporated thereinto, showing a first embodiment of an electrically insulative covering according to the present invention.
Figure 2B:
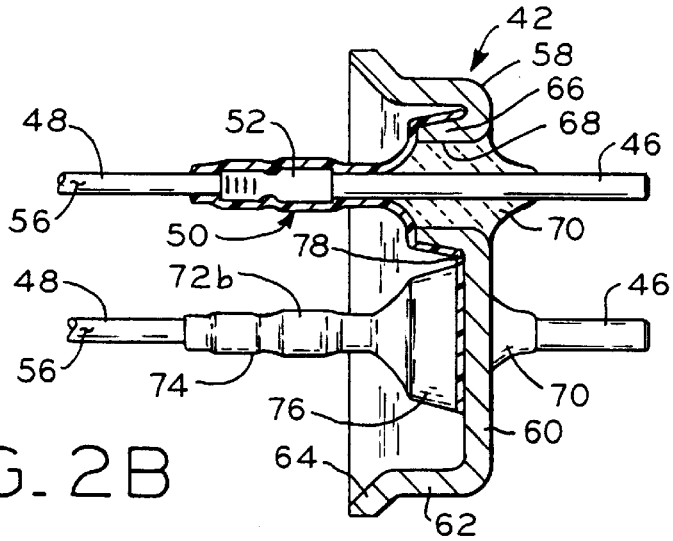
FIG. 2B is an enlarged longitudinal sectional view of the terminal assembly of the compressor of FIG. 1, the present invention having been incorporated thereinto, showing a second embodiment of an electrically insulative covering according to the present invention.
Figure 3:
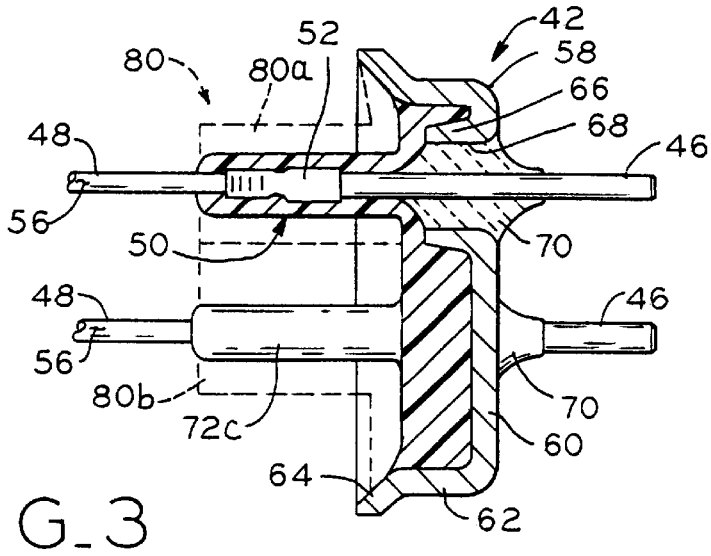
FIG. 3 is an enlarged longitudinal sectional view of the terminal assembly of the compressor of FIG. 1, the present invention having been incorporated thereinto, showing a third embodiment of an electrically insulative covering according to the present invention.

Terminal assembly 42 includes metallic, cup-shaped terminal body 58 having end wall 60 and cylindrical side wall 62, as best seen in FIGS. 2A, 2B and 3. Terminal body side wall 62 is integrally formed with end wall 60 and extends approximately perpendicularly therefrom. Integral with the annular edge of side wall 62 opposite end wall 60 is flange 64, which abuts the interior periphery of housing aperture 40 (FIG. 1). Located in end wall 60 are a plurality (usually three) inwardly projecting collars 66 which extend substantially parallel with side wall 62 and define apertures 68 through which conductor pins 46 pass through terminal body 58. A fused glass insulator 70 is formed in each aperture 68 and retains conductor pin 46 to collar 66; thus pins 46 are electrically insulated from terminal body 58, housing 22, and each other, insulators 70 forming a hermetic seal for housing 22. The above structure is known, and the present invention as described hereinbelow may be adapted thereto.

In accordance with the present invention, to protect against the possibility of arcing across carbon or conductive deposits which may form on the exposed interior surfaces of the compressor assembly during operation, electrically insulative covering 72 is provided which continually extends over a portion of terminal body 58, each insulator 70, the interior end of conductor pin 46, electrical connector clip 52 and a portion of lead wire jacket 56. Unlike previous insulative covers or coatings, the present invention provides an insulative covering of insulators 70 as well as all of the otherwise exposed conductive elements proximal to and/or associated with the interior electrical connection of the of lead wires to the terminal assembly, thereby preventing any arcing therebetween. Because there is no opportunity for carbon or conductive deposits to form a conductive path between elements having different electrical potentials, arcing across the terminal assembly is prevented, and the risk of fused glass insulators 70 being melted is avoided.

Referring to FIG. 2A, there is shown a first embodiment of the present invention. Covering 72*a* has the form of a sleeve, and may be molded to form a boot, as shown, which has integral elongate, generally cylindrical portion 74 and larger diameter bell end portion 76, each lead wire/conductor pin connection having an individual boot. Boot portion 74 extends along and over the exposed interior end of conductor pin 46, connector clip 52, and a portion of lead wire jacket 56; boot portion 74 extends over the interior surfaces of insulator 70 and collar 66. Boots 72*a* are formed of a suitable electrically insulative material, which can withstand sustained exposure to high temperature and pressure refrigerant and oil, such as synthetic rubber; for example, Buna-Nitrile or Styrene-Butadiene may be used. In their pre-installed state, the shapes of boots 72*a* do not conform to the surfaces they cover as closely as shown in FIG. 2A. Boots 72*a* are slid onto lead wires 48, beyond connector clip 52, prior to electrical connection 50 being made. Connection 50 is made and the boots are slid into their shown position over the surfaces to be covered; at this point, however, the fit is rather loose. Once in their desired position, a sufficient amount of heat at a temperature below 325° F. is applied to the boots to heat shrunk them into closely conformance to the surfaces they cover, as shown, to eliminate gaps between the covered surfaces and the covering, thereby substantially encase the conductive materials therein. Notably, each boot 72*a* continually extends over a portion of terminal body 58, insulator 70, pin 46, connector clip 52 and a portion of lead wire jacket 56 (see FIG. 4).

Referring to FIG. 2B, there is shown a second embodiment of the present invention. Insulative covering 72*b* is substantially identical to covering 72*a* of FIG. 2A, and is applied in substantially the same way. Covering 72*b*, however, comprises a plurality of boot members which are integrally joined at their bell end portions 76 by web portion 78, which connects each boot member and properly aligns them relative to conductor pins 46 and collars 66. Vis-a-vis boots 72*a*, boot 72*b* thus reduces the number of individual covering elements which are required per assembly, and provides some process advantages with regard to assembly and handling, and better assures that a consistent number of covering elements are installed. As with boots 72*a*, boot 72*b* is slidably disposed onto lead wires 48, beyond connector clips 52, prior to electrical connections 50 being made. Subsequent to electrical connection 50 being made, boot 72*b* is slid into place and heat shrunk as described above, thereby insulatively encasing the electrically conductive elements. As before, covering 72*b* extends over a portion of each lead wire jacket 56 (see FIG. 4).

Referring to FIG. 3, there is shown a third embodiment of the present invention. Unlike the first and third embodiments, in which sleeves or boots are assembled onto the electrical connection and the terminal assembly, covering 72*c* is injection molded in place over the components to be covered. Again the insulative material may be a synthetic rubber, such as Buna-Nitrile or Styrene-Butadiene. After electrical connections 50 have been made, mold 80, having a plurality of separable portions (e.g. 80*a*, 80*b*), is located about the connection and the interior of terminal assembly 42. Mold 80 is positioned over portions of lead wire insulative jackets 56, connections 50, the interior ends conductor pins 46, insulators 70, and is sized to fit tightly inside side walls 62 of terminal body 58. The insulative material is then injected into the mold, substantially filling terminal body 58 and flowing over insulators 70, the interior ends of conductor pins 46, connector clips 52 and portions of lead wire jackets 56 (see FIG. 4), the insulative material conforming closely to the surfaces of the elements being covered thereby. The insulative material may be allowed to cure inside mold, or the mold may be removed, and insulative covering 72*c* then allowed to cure.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hermetic compressor assembly comprising:

a housing;

an electric motor disposed in said housing;

a compression mechanism disposed in said housing and operatively coupled to said motor;

a terminal assembly comprising a terminal body extending through and sealingly attached to said housing, at least one elongate conductor pin having interior and exterior ends, said interior pin end located inside said housing, said exterior pin end located outside said housing, and an insulator disposed between said pin and said terminal body, whereby said pin is electrically insulated from said terminal body by said insulator;

a lead wire extending between said motor and said interior pin end, said lead wire having an electrical connection to said pin at a location inside of said housing and substantially outside of said terminal body, said motor and said pin electrically connected by said lead wire, said lead wire having an insulative jacket; and an insulative covering which extends between said terminal body and said lead wire jacket, said insulative covering covering at least a portion of said terminal body, said insulator, said electrical connection between said lead wire and said pin, and at least a portion of said lead wire jacket.

2. The hermetic compressor assembly of claim 1, wherein said insulative covering is substantially conformed to the surfaces over which it extends.

3. The hermetic compressor assembly of claim 1, wherein said insulative covering comprises a sleeve, said sleeve slidably disposed over said electrical connection.

4. The hermetic compressor assembly of claim 3, wherein said sleeve is a molded boot.

5. The hermetic compressor assembly of claim 4, comprising a plurality of said lead wires, and wherein said terminal assembly comprises a plurality of said elongate conductor pins, each said pin interior end having an electrical connection to a said lead wire, and said insulative covering comprises a plurality of integrally connected, molded boots, each said boot covering an insulator and extending over a portion of the jacket of a said lead wire.

6. The hermetic compressor assembly of claim 5, wherein each said boot is substantially sealingly disposed over at least one of a portion of said lead wire jacket and a portion of said terminal assembly.

7. The hermetic compressor assembly of claim 3, wherein said sleeve is substantially sealingly disposed over at least one of a portion of said lead wire jacket and a portion of said terminal assembly.

8. The hermetic compressor assembly of claim 7, wherein said sleeve is heat-shrunk onto at least one of a portion of said lead wire and a portion of said terminal body.

9. The hermetic compressor assembly of claim 1, wherein said insulative covering comprises an insulative coating applied over said electrical connection.

10. The hermetic compressor assembly of claim 9, wherein said insulative coating is molded in place.

11. The hermetic compressor assembly of claim 10, wherein said insulative coating substantially fills said terminal body.

12. The hermetic compressor assembly of claim 10, wherein said insulative coating is synthetic rubber.

13. The hermetic compressor assembly of claim 12, wherein said synthetic rubber is a material selected from the group consisting of Buna-Nitrile and Styrene-Butadiene.

14. The hermetic compressor assembly of claim 9, comprising a plurality of said lead wires, and wherein said terminal assembly comprises a plurality of elongate conductor pins, each said pin interior end having an electrical connection to a said lead wire, said insulative coating extending over a portion of the jacket of each said lead wire.

15. The hermetic compressor assembly of claim 1, wherein said insulator is fused glass.

16. A hermetic compressor assembly comprising:

a housing;

an electric motor disposed in said housing;

a compression mechanism disposed in said housing and operatively coupled to said motor;

a terminal assembly comprising a terminal body extending through and sealingly attached to said housing, at least one elongate conductor pin having interior and exterior ends, said interior pin end located inside said housing, said exterior pin end located outside said housing, and an insulator disposed between said pin and said terminal body, whereby said pin is electrically insulated from said terminal body by said insulator;

a lead wire extending between said motor and said interior pin end, said lead wire having an electrical connection to said pin at a location inside of said housing and substantially outside of said terminal body, said motor and said pin electrically connected by said lead wire, said lead wire having an insulative jacket; and means for continuously covering at least a portion of said lead wire jacket, said electrical connection between said lead wire and said pin, said insulator and at least a portion of said terminal body.

17. The hermetic compressor assembly of claim 16, wherein said terminal body is provided with a plurality of apertures, a conductor pin extending through each said aperture, a said insulator being disposed in each said aperture and about the said conductor pin extending therethrough.

18. The hermetic compressor assembly of claim 16, wherein said means for continuously covering a portion of said lead wire jacket, said electrical connection between said lead wire and said pin, said insulator and a portion of said terminal body comprises an electrically insulative covering.

19. The hermetic compressor assembly of claim 18, wherein said insulative covering is substantially conformed to the surfaces over which it extends.

20. The hermetic compressor assembly of claim 18, wherein said insulative covering comprises a sleeve, said sleeve slidably disposed over said electrical connection.

21. The hermetic compressor assembly of claim 20, wherein said sleeve is a molded boot.

22. The hermetic compressor assembly of claim 21, comprising a plurality of said lead wires, and wherein said terminal assembly comprises a plurality of elongate conductor pins, each said pin interior end having an electrical connection to a said lead wire, and said insulative covering comprises a plurality of integrally connected, molded boots, each said boot covering an insulator and extending over a portion of the jacket of a said lead wire.

23. The hermetic compressor assembly of claim 22, wherein each said boot is substantially sealingly disposed over at least one of a portion of said lead wire jacket and a portion of said terminal assembly.

24. The hermetic compressor assembly of claim 23, wherein said insulative covering is heat shrunk to at least one of a portion of said lead wires and a portion of said terminal body.

25. The hermetic compressor assembly of claim 16, wherein said insulative covering comprises an over-mold, said over-mold being molded into place so as to substantially fill said terminal body.

26. The hermetic compressor assembly of claim 25, said insulative covering being molded over said electrical connection, said glass insulator and said conductor pin.

27. The hermetic compressor assembly of claim 25, wherein said insulative covering is synthetic rubber.

28. The hermetic compressor assembly of claim 27, wherein said insulative covering is a material such as Buna-Nitrile or Styrene-Butadiene.

29. A hermetic compressor assembly comprising:

a housing;

a motor comprising a rotor and a stator disposed in said housing;

a compression mechanism disposed in said housing and operatively coupled to said rotor;

at least one jacketed lead wire electrically connected to said stator;

a terminal assembly comprising a terminal body extending through and sealingly attached to said housing, at least one elongate conductor pin extending through said terminal body, and an insulator disposed between said pin and said terminal body;

an electrical connection between said lead wire and said conductor pin located inside of said housing and substantially outside of said terminal body; and means for insulatively covering said electrical connection, said conductor pin and said insulator.

30. The hermetic compressor assembly of claim 29, further comprising a plurality conductor pins and a plurality of jacketed lead wires, each said conductor pin having an electrical connection to a said lead wire.

31. The hermetic compressor assembly of claim 29, wherein said means for insulatively covering also covers a portion of said lead wire jacket.

32. The hermetic compressor assembly of claim 29, wherein said insulator is fused glass.

33. The hermetic compressor assembly of claim 29, wherein said means for insulatively covering comprises a sleeve slidably disposed into a position over said electrical connection, said conductor pin and said insulator, and a portion of said wire jacket.

34. The hermetic compressor assembly of claim 33, wherein said sleeve is a molded boot.

35. The hermetic compressor assembly of claim 33, wherein said sleeve is heat-shrunk onto said lead wire, said electrical connection, said conductor pin and said insulator.

36. The hermetic compressor assembly of claim 29, wherein said means for insulatively covering comprises an over-molding, said over-molding being molded in place and at least partially filling said terminal body.

37. The hermetic compressor assembly of claim 36, wherein said over-molding comprises synthetic rubber.

38. A method of applying an insulative covering over the electrical connection between the terminal assembly and the motor of a hermetic compressor, comprising the steps of:

providing a terminal assembly comprising a body, at least one conductor pin extending through the body, and an insulator disposed between the body and the pin, at least one jacketed lead wire, and an insulative covering material;

establishing an electrical connection between the lead wire and the conductor pin substantially outside of the terminal body; and applying the insulative covering material over at least a portion of the terminal body, the insulator, a portion of the conductor pin, the electrical connection between the lead wire and the pin, and at least a portion of the lead wire jacket.

39. The method of claim 38, wherein the insulative covering material comprises a sleeve, and comprising, prior to said step of establishing an electrical connection, the step of sliding the sleeve over the lead wire, and wherein said step of applying the insulative covering comprises sliding the sleeve into a position over a portion of the terminal body, the insulator, a portion of the conductor pin, the electrical connection between the lead wire and the pin, and a portion of the lead wire jacket.

40. The method of claim 39, wherein said sleeve has the form of a molded boot.

41. The method of claim 39, further comprising the step of heat shrinking the sleeve after it has been slid into its position over a portion of the terminal body, the insulator, a portion of the conductor pin, the electrical connection between the lead wire and the pin, and a portion of the lead wire jacket.

42. The method of claim 38, wherein said step of applying comprises molding the insulative material over a portion of the terminal body, the insulator, a portion of the conductor pin, the electrical connection between the lead wire and the pin, and a portion of the lead wire jacket.

43. The method of claim 42, further comprising, after said step of establishing an electrical connection, the steps of placing a mold over the electrical connection and the terminal assembly, injecting the insulative material into the mold.

44. A method of applying an insulative covering over the electrical connection between the terminal assembly and the motor of a hermetic compressor, comprising the steps of:

providing a terminal assembly comprising a body, at least one conductor pin extending through the body, and an insulator disposed between the body and the pin, at least one jacketed lead wire, and an insulative covering material;

establishing an electrical connection between the lead wire and the conductor pin;

placing a mold over the electrical connection and the terminal assembly;

injecting the insulative material into the mold;

molding the insulative covering material over at least a portion of the terminal body, the insulator, a portion of the conductor pin, the electrical connection between the lead wire and the pin, and at least a portion of the lead wire jacket; and removing the mold.

45. The method of claim 42, wherein said insulative material is synthetic rubber.

46. The method of claim 42, wherein said step of applying comprises at least partially filling the terminal body with the insulative material.

47. The method of claim 42, further comprising the step of curing the insulative material after it has been over-molded.

* * * * *